US008747134B2

(12) United States Patent
Schlögl

(10) Patent No.: US 8,747,134 B2
(45) Date of Patent: Jun. 10, 2014

(54) PLUG-IN COUPLING

(75) Inventor: Gerhard Schlögl, Wernberg (DE)

(73) Assignee: Hilde Schlögl, Wernberg (DE)

( * ) Notice: Subject to any disclaimer, the term of this patent is extended or adjusted under 35 U.S.C. 154(b) by 78 days.

(21) Appl. No.: 13/497,863

(22) PCT Filed: Aug. 17, 2010

(86) PCT No.: PCT/DE2010/000968

§ 371 (c)(1),
(2), (4) Date: May 1, 2012

(87) PCT Pub. No.: WO2011/035755

PCT Pub. Date: Mar. 31, 2011

(65) Prior Publication Data

US 2012/0282792 A1 Nov. 8, 2012

(30) Foreign Application Priority Data

Sep. 23, 2009 (DE) ..... 10 2009 042 569

(51) Int. Cl.
*H01R 4/60* (2006.01)

(52) U.S. Cl.
USPC ..... 439/194

(58) Field of Classification Search
USPC ..... 439/188, 190–206; 200/51.09
See application file for complete search history.

(56) References Cited

U.S. PATENT DOCUMENTS 3,082,394 A * 3/1963 Hahn et al. ..... 439/191
3,649,949 A * 3/1972 McCarthy et al. ..... 439/194
3,742,427 A * 6/1973 Ballard ..... 439/188
3,845,450 A * 10/1974 Cole et al. ..... 439/141
4,106,523 A * 8/1978 Thornton et al. ..... 137/614.04
4,111,452 A * 9/1978 Carlsson ..... 280/421
4,117,287 A * 9/1978 Walker et al. ..... 200/82 R
4,302,064 A * 11/1981 Spinner ..... 439/198
4,357,064 A * 11/1982 Palone ..... 439/320
5,810,048 A * 9/1998 Zeiner-Gundersen ... 137/614.04
6,079,446 A * 6/2000 Tocha ..... 137/614.06
6,603,088 B2 * 8/2003 Grejon et al. ..... 218/68
7,052,047 B1 * 5/2006 Box et al. ..... 285/123.15
7,364,448 B2 * 4/2008 Cairns et al. ..... 439/201
7,641,489 B1 * 1/2010 Hsu et al. ..... 439/188

(Continued)

FOREIGN PATENT DOCUMENTS

DE 199 16 984 7/2000

*Primary Examiner* — Ross Gushi
(74) *Attorney, Agent, or Firm* — Daniel A. Thomson; Emerson Thomson Bennett LLC

(57) ABSTRACT

The invention relates to a plug-in coupling system for the transfer of high-power energy and for the transfer of a fluid under pressure, consisting of at least one coupler plug (2, 2') and at least one coupler socket (3, 3') with at least one electrical conductor (4, 5), respectively. The coupler plug (2, 2') can be introduced into the coupler socket (3, 3') to produce a coupled state and can be removed from the coupler socket (3, 3') to produce a decoupled state. The plug-in coupling advantageously comprises at least one electromechanical protection system consisting of at least one electronic switch means (35) and at least one mechanical switch means (4, 11), arranged inside the coupler socket (3) and/or the coupler plug (2), said mechanical switch means establishing or separating the electroconductive connection, the electronic switch means (35) and the mechanical switch means (4, 11) being independently controllable.

16 Claims, 9 Drawing Sheets

(56) References Cited

U.S. PATENT DOCUMENTS

| | | | | |
|---|---|---|---|---|
| 7,718,899 | B2 * | 5/2010 | Benestad et al. | 174/152 R |
| 7,751,216 | B2 * | 7/2010 | Su | 363/146 |
| 7,762,824 | B2 * | 7/2010 | Smith, III | 439/192 |
| 7,931,484 | B2 * | 4/2011 | Chen | 439/188 |
| 7,982,144 | B2 * | 7/2011 | Kiryu et al. | 200/51 R |
| 7,982,145 | B2 * | 7/2011 | Yuba et al. | 200/51 R |
| 8,517,749 | B2 * | 8/2013 | Marshall | 439/194 |
| 2002/0154461 | A1 | 10/2002 | Chapman | |
| 2003/0085108 | A1 * | 5/2003 | Chiang et al. | 200/51.09 |
| 2004/0214462 | A1 * | 10/2004 | Huang | 439/188 |
| 2007/0243739 | A1 * | 10/2007 | Cairns et al. | 439/199 |
| 2010/0029110 | A1 * | 2/2010 | Kiryu et al. | 439/188 |
| 2010/0197156 | A1 * | 8/2010 | Chen | 439/188 |
| 2010/0221940 | A1 * | 9/2010 | Hoyack et al. | 439/188 |
| 2011/0117759 | A1 * | 5/2011 | Beak et al. | 439/92 |
| 2011/0117762 | A1 * | 5/2011 | Beak et al. | 439/188 |
| 2012/0276766 | A1 * | 11/2012 | Schlogl | 439/196 |
| 2012/0282792 | A1 * | 11/2012 | Schlogl | 439/196 |

* cited by examiner

PLUG-IN COUPLING

The invention relates to a plug-in coupling according to the preamble of claim 1.

In motor vehicles, utility vehicles, construction and agricultural machinery, the transfer of high-power energy has been achieved in the past by means of hydraulic and/or mechanical concepts. Increasingly there are attempts to use electric motors in the vehicle drive train and for driving auxiliary equipment, the electric power for which is supplied by a generator that is powered by a combustion motor. For this purpose it is necessary to provide the vehicle with an electric network for connecting numerous electric generators and consumers, such as generators, drives, power take-off components or electrically operated implements.

In order to transfer high-power energy in such an electric network it is advantageous to cool the electrical conductors by means of a liquid coolant, in order to minimize the conductor cross section necessary for a specified power to be transferred.

As an interface between the single electric generators and consumers, couplings are necessary that in addition to an electrical connection also establish connections between the respective cooling channels of the electric cables.

Based on this, the object of the invention is to present a plug-in coupling that enables simple, manageable and frequent disconnection and connection of the plug-in coupling elements, taking into account the high-power energy transferred. This object is achieved based on the characteristics of the preamble of claim 1.

High-power energy according to this invention refers to a power range of 50 kW to 300 kW at an electric current of 50 A to 400 A.

The essential aspect of the plug-in coupling according to the invention is that the coupler socket and the coupler plug have at least one inner conductor that is electroconductive in at least some sections, that is surrounded at least in some sections by a fluid channel and that means are provided in the coupler socket and coupler plug that are designed for sealing the fluid channel in a liquid-tight manner in the decoupled state and for producing a continuous fluid channel in the coupled state. Advantageously the means consist of spring-loaded and movable valve bodies that are moved in the coupled state so that the plug-in coupling forms a continuous fluid channel. At least one of these valve bodies is designed to produce an electroconductive connection between the inner conductors of the coupler socket and of the coupler plug. The plug-in coupling described here is especially easy to plug in and further is extremely reliable in establishing the electrical connection with approximately simultaneous production of the continuous fluid channel. The valve body of the coupler plug advantageously consists at least to some extent of the inner conductor.

The coupler socket comprises a coupler socket housing and the valve body, which is preferably sleeve-like in design, is provided movably between the inner conductor and the coupler socket housing. Further, the valve body is advantageously connected with the coupler socket in an electrically insulated manner by means of an electrically conductive contact sleeve. The contact sleeve surrounds the inner conductor of the coupler socket on a partial length and can be moved relative to said inner conductor.

Advantageously the inner conductor of the coupler socket is designed as having several parts, namely comprising at least two inner conductor elements that are connected with each other in an electrically insulated manner. Preferably the at least two inner conductor elements are connected with each other by a pin of an electrically insulating material, in particular a ceramic pin. In the coupled state the two inner conductor elements are electroconductively connected by means of the contact sleeve, the contact sleeve electroconductively connecting the two inner conductor elements in the coupled state being the contact sleeve connected with the valve body of the coupler socket.

Advantageously, the coupler plug and the coupler socket are designed so that during transition from the decoupled state to the coupled state, first the fluid connection and then the electrical connection between the coupler plug and the coupler socket is produced.

Further embodiments, advantages and applications of the invention are also disclosed in the following description of exemplary embodiments and the drawings. All characteristics described and/or pictorially represented, alone or in any combination, are subject matter of the invention, regardless of their being summarized or referenced in the claims. The content of the claims is also an integral part of the description. The invention is illustrated in the drawings, where:

Figure 1:
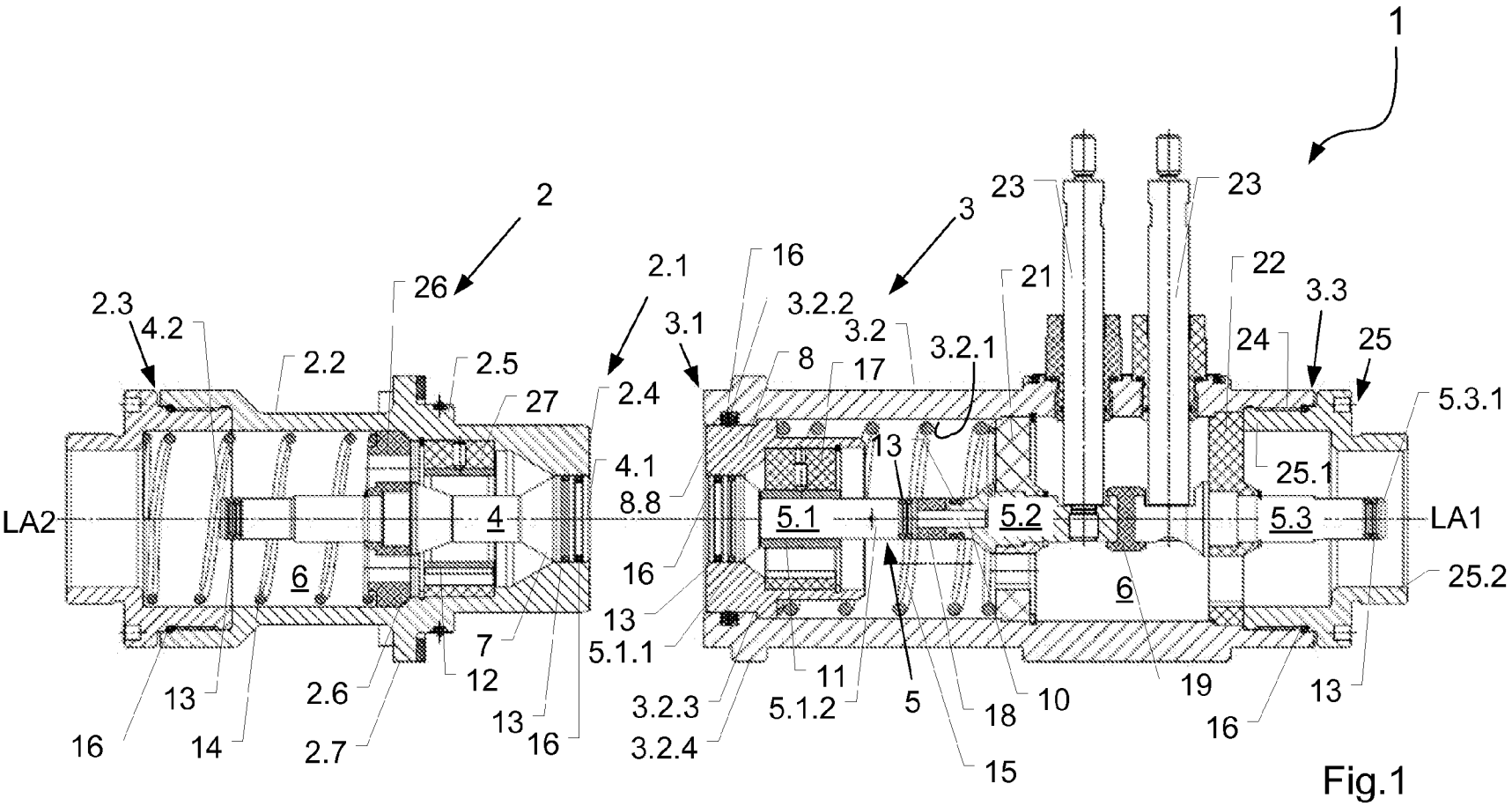
FIG. 1 shows exemplarily a plug-in coupling according to the invention in the decoupled state, in a side cross section view.
Figure 2:
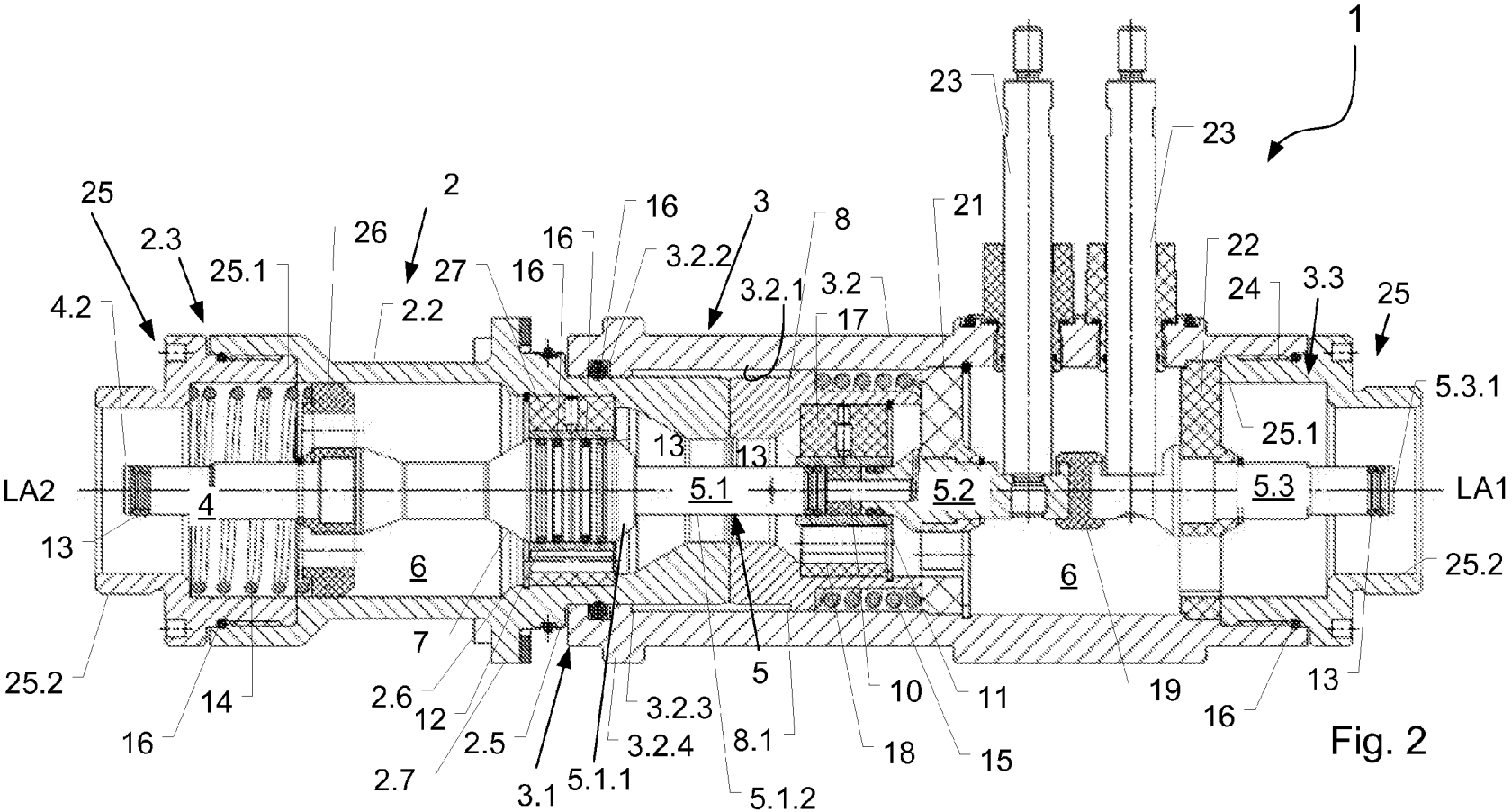
FIG. 2 shows exemplarily a plug-in coupling according to the invention in the coupled state, in a side cross section view.

FIG. 1 shows a plug-in coupling 1 according to the invention in the decoupled state and FIG. 2 shows the coupling in the coupled state, both in side cross section views. The plug-in coupling 1, which is designed for the transfer of high-power energy and simultaneous transfer of a pressurized fluid, consists of at least one coupler plug 2 and at least one coupler socket 3; the coupler plug 2 can be introduced at least to some extent into the coupler socket 3 to produce a coupled state and can be removed from the coupler socket 3 to produce a decoupled state.

According to the invention, the coupler socket 3 and the coupler plug 2 comprise at least one inner conductor 4, 5 which is electroconductive in at least some sections and preferably is surrounded by a fluid channel 6 in a ring-like manner. Further, one valve body 7, 8 is provided both in the coupler plug 2 and in the coupler socket 3, respectively, for sealing the fluid channel 6 in the decoupled state of the plug-in coupling 1.

The valve bodies 7, 8 can be moved within the coupler socket 3 and the coupler plug 2 and in the decoupled state are positioned by means of springs 14, 15, which in particular can be coil springs, so that the coupler plug 2 and the coupler socket 3 are sealed in a liquid-tight manner by the valve body 7 and by the valve body 8 respectively on the coupler plug end 2.1 and on the coupler socket end 3.1, respectively.

During introduction of the coupler plug 2 in the coupler socket 3 the valve body 7 is moved within the coupler plug 2 and the valve body 8 is moved within the coupler socket 3 so that the plug-in coupling 1 produces a continuous fluid channel in the coupled state. The movement of the valve bodies 7, 8 not only produces a continuous fluid channel 6 through the plug-in coupling 1, but also an electrical connection between the inner conductors 4, 5 of the coupler plug 2 and of the coupler socket 3.

Figure 3:
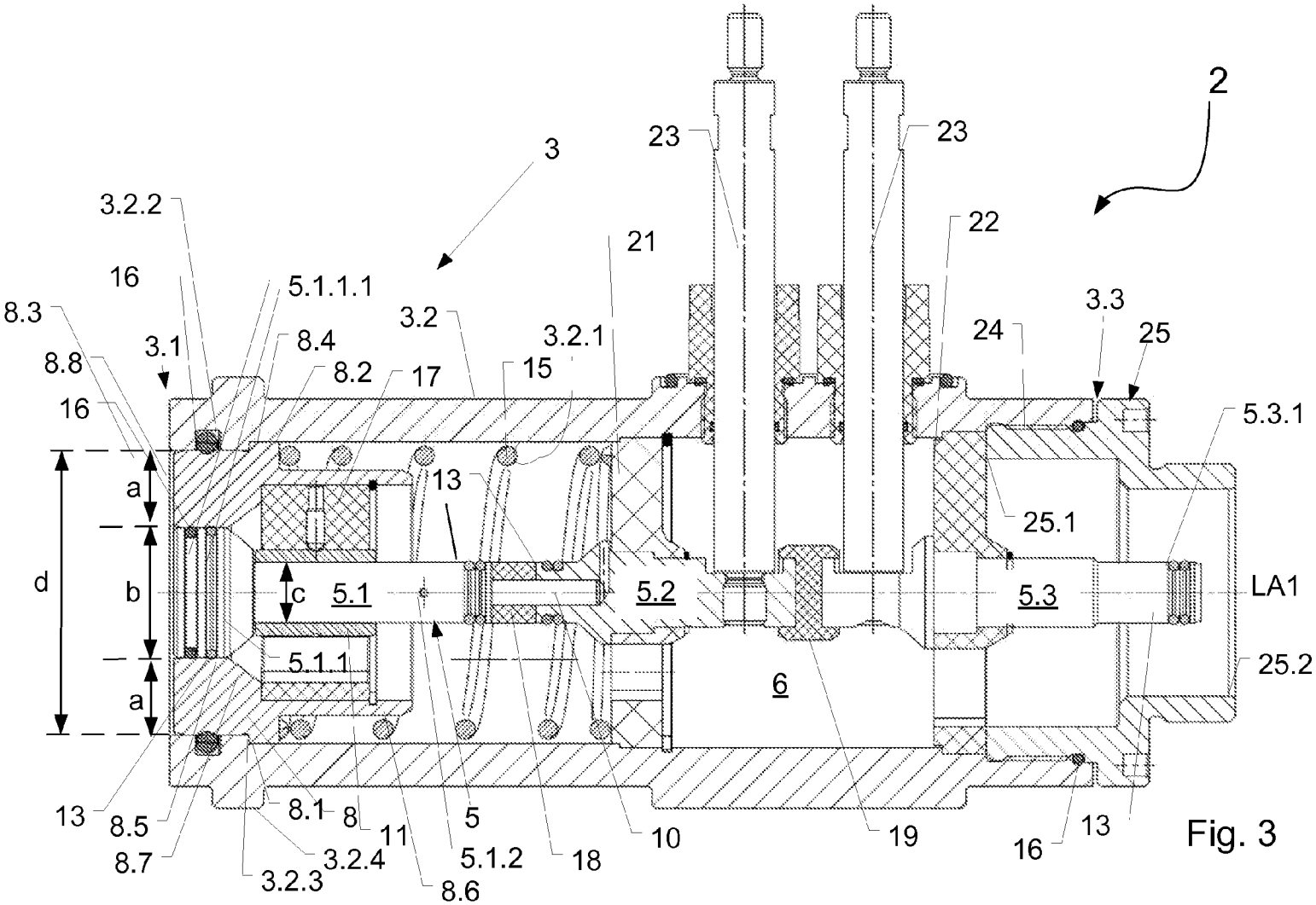
FIG. 3 shows exemplarily a coupler socket according to the invention in the decoupled state, in a side cross section view.

In the following, the design of the coupler socket 3 and of the coupler plug 2 is described based on FIGS. 3 and 4.

The coupler socket 3 consists of an essentially tube-shaped coupler socket housing 3.2, which on the first coupler socket end 3.1 has a circular opening with a diameter d, which (opening) is sealed in a liquid-tight manner by the in front cross section circular ring-shaped valve body 8 having a circular opening with diameter b and the first inner conductor element 5.1 received in this opening with its thickened end 5.1.1. Both the first inner conductor element 5.1 and the adjoining second and third inner conductor elements 5.2, 5.3 as well as the valve body 8 are arranged concentrically to the longitudinal axis LA1 of the coupler socket 3. The valve body 8 guided on the inner conductor 5 and surrounding the latter circumferentially is movably guided between the inner conductor 5 and the coupler socket housing 3.2. For liquid-tight sealing, the coupler socket housing 3.2 has on its inner side 3.2.1 in the area of the first coupler socket end 3.1 a groove 3.2.2 for receiving a seal 16; both the groove 3.2.2 and the seal 16 are preferably ring-shaped circumferentially around the valve body 8.

The valve body 8 has on its outer circumferential side facing the first inner side 3.2.1 of the coupler socket housing 3.2 for example one first and second gradation 8.1, 8.2, so that three sub-sections are formed on the outer circumferential side of the valve body 8, which preferably extend concentrically to the longitudinal axis LA1 of the coupler socket 3 and with a different radial clearance to this longitudinal axis LA1.

The first gradation 8.1 is adapted to the gradation 3.2.3 of the inner side 3.2.1 of the coupler socket housing 3.2. The outer diameter d of the valve body 8 in the sub-section 8.3 of the valve body 8 is adapted to the diameter d of the opening of the coupler socket housing 3.2 on the first coupler socket end 3.1. This causes the seal 16 to seal the sub-section 8.3 of the valve body 8 circumferentially and seals the coupler socket 3 in a liquid-tight manner on this boundary surface in the area of the first coupler socket end 3.1.

The inner circumferential side of the valve body 8 facing the inner conductor 5 is likewise gradated, namely with a first inner side area 8.5 near the first coupler socket end 3.1 and a second inner side area 8.6 separated by a gradation 8.7. The first inner side area 8.5 and the second inner side area 8.6 extend concentrically to the longitudinal axis LA1, the first inner side area 8.5 having a smaller distance to the longitudinal axis LA1 than the second inner side area 8.6. The first inner side area 8.5 has a distance b/2 to the longitudinal axis LA 1, so that the top area 5.1.1 of the first inner conductor element 5.1 having a diameter b, is received exactly in the inside of the valve body 8 in the decoupled state. The first inner conductor element 5.1 comprises a circumferential groove 5.1.1.1 for receiving a circumferential seal 16 in the top area 5.1.1. This seal 16 seals the boundary surface between the valve body 8 and the top area 5.1.1 of the first inner conductor element 5.1 in a liquid-tight manner.

In the end of the top area 5.1.1 facing away from the first coupler socket end 3.1 the first inner conductor element 5.1 becomes smaller and changes into an inner conductor area 5.1.2 of cylindrical form with an outer diameter c. The inner conductor area 5.1.2 is surrounded over a partial length by an electrically conductive, round tube-shaped contact sleeve 11, which is firmly connected with the valve body 8 in the second inner side area 8.6 by means of an electrically non-conductive insulating body 17, for example of plastic. The insulating body 17 preferably has several flow channels extending parallel to the longitudinal axis LA1 through which fluid flow is made possible in the coupled state of the plug-in coupling 1.

In the depicted exemplary embodiment the inner conductor 5 of the coupler socket 3 consists of several, preferably three, inner conductor elements 5.1, 5.2, 5.3. To achieve a de-energized state of the contact surfaces of the plug-in coupling 1 in the decoupled state, the first through third inner conductor elements 5.1, 5.2, 5.3 are galvanically separated by insulating bodies 18, 19 and the first inner conductor element 5.1 is galvanically separated from the second inner conductor element 5.2 by a pin of an electrically insulating material, in particular a ceramic pin 10 of zirconium oxide. On the two end sides of the insulating body 18 there is at least one, preferably several spring contacts 13, namely in grooves, so that the spring contacts 13 circumferentially extending around the first and second inner conductor elements 5.1, 5.2 are partially recessed into the first and second inner conductor elements 5.1, 5.2. This construction ensures in the decoupled state of the plug-in coupling 1 the galvanic separation of the first and second inner conductor elements also during transfer of high-power energy and in the coupled state by movement of the contact sleeve 11 over the insulating body 18 and the thereon adjoining spring contacts 13 achieves an electric short circuit of the insulating body 18 and of the ceramic pin 10, so that the first and second inner conductor elements 5.1, 5.2 are connected electroconductively with each other.

For positionally correct fastening of the second inner conductor element 5.2 and of the connected first inner conductor element 5.1, an insulating disk 21, preferably manufactured from electrically insulating fiberglass-reinforced plastic, is provided within the coupler socket housing 3.2. The insulating disk 21 preferably has several flow channels extending along the longitudinal axis LA1 for producing a continuous fluid channel 6 through the coupler socket 3 in the coupled state of the plug-in coupling 1. The insulating disk 21 ensures the concentric alignment of the inner conductor elements 5.1, 5.2 within the coupler socket housing 3.2 and also secures the same against movement.

Due to the high electrical insulation of the insulating disk 21, the inner conductor 5, in particular the second inner conductor element 5.2, is galvanically separated from the electrically conductive coupler socket housing 3.2 which is preferably made of steel. Between the insulating disk 21 and the valve body 8, a pre-tensioned coiled spring 15, in particular a compression spring, is provided, preferably concentrically around and at a distance from the longitudinal axis LA1. This spring is supported in the bottom area on the side surface of the insulating disk 21 and in the top area on the second gradation 8.2 of the valve body 8, so that this valve body 8 in the decoupled state, i.e. with the coupler plug 2 being pulled out of the coupler socket 3, is pressed in the direction of the first coupler socket end 3.1 and due to the first gradation 8.1 of the valve body 8 that engages with the gradation 3.2.3 of the inner side 3.2.1 of the coupler socket housing 3.2, is exactly flush with the first coupler socket end 3.1. Upon introduction of the coupler plug 2 into the coupler socket 3 the valve body 8 is moved against the spring force of the spring 15 along the longitudinal axis LA1 of the coupler socket 3 within the latter, the valve body 8 being guided due to the contact sleeve 11 on the inner conductor area 5.1.2 of the first inner conductor element 5.1.

In the coupler socket 3 depicted in the exemplary embodiment, in a middle area that is limited on the side by the insulating disks 21, 22, approximately centered between said insulating disks 21, 22 and concentrically to the longitudinal axis LA1 there is an insulating body 19 that keeps the second and third inner conductor element 5.2, 5.3 apart and electrically insulates them from each other. Bore holes, into which pins 23 engage with their free ends, are provided in the second and third inner conductor element 5.2, 5.3, preferably at a right angle to the longitudinal axis LA1. These pins 23 are preferably designed as relay jumpers and lead approximately at a right angle from the coupler socket housing 3.2, the penetration points of the pins 23 through the coupler socket housing 3.2 being electrically insulated from the coupler socket housing 3.2 and designed in a liquid-tight manner. By means of these pins 23 the inner conductor 5 leads out of the coupler socket housing 3.2 so that a current flow through the coupler socket is ensured only when the pins 23 serving for example as relay jumpers are bridged by means of an electrical connecting means, preferably a relay, provided outside of the coupler socket housing. This makes it possible to create an electrically controllable safety device that in addition to existing mechanical safety devices enables electric current and voltage disconnection of the inner conductor 5 of the coupler socket 3.

Adjoining the insulating disk 22 the coupler socket housing 3.2 has inner threads 24 on its second coupler socket end 3.3 into which (threads) a reducing sleeve 25 can be screwed with its outer threads provided on the free end 25.1. To produce a liquid-tight connection of the second coupler socket end 3.3 with the free end 25.1 of the reducing sleeve 25, a seal 16 is provided between these elements and is preferably held positionally correct in a groove or notch on the reducing sleeve 25. The free end 25.2 of the reducing sleeve 25 has a reduced diameter as opposed to the free end 25.1 and serves to connect a hose fitting, which is part of a liquid cooled electric cable, in which an electrical conductor is surrounded circumferentially by a fluid channel, in which a pressurized fluid can be carried. The free end 25.2 has outer threads on its outer circumference, so that a hose fitting can be screwed, preferably in a liquid-tight manner, onto the reducing sleeve 25.

The inner conductor element 5.3, held for the most part concentrically in the area of the reducing sleeve 25 which (inner conductor element) is held by the insulating disk 22 positionally correct within the coupler socket housing 3.2 and the reducing sleeve 25 and comprises flow channels for flow of the fluid, has on its free end 5.3.1 located in the area of the free end 25.2 of the reducing sleeve 25, at least one, preferably a pair of adjacent spring contacts 13. These spring contacts 13 are held at least to some extent in grooves or notches of the third inner conductor element 5.3, and are thus held positionally correct. These spring contacts 13 serve to produce an electrical contact to an inner conductor, which is provided within a hose fitting attached to the reducing sleeve. The inner conductor of the hose fitting can for example be pushed with a blind hole-like end of the inner conductor onto the free end 5.3.1 of the third inner conductor element. The spring contacts 13 establish a highly conductive electrical connection between these elements.

Figure 4:
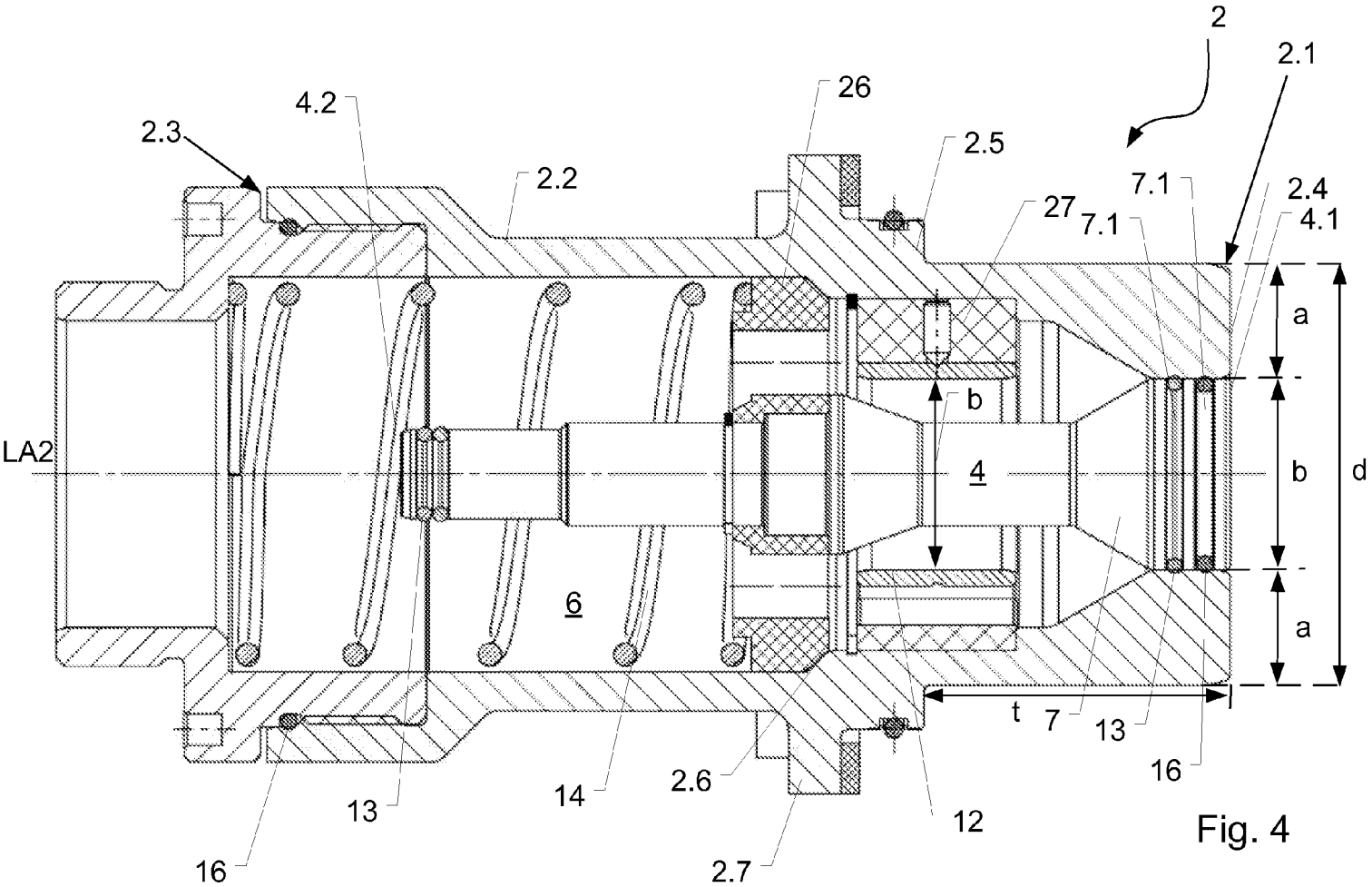
FIG. 4 shows exemplarily a coupler plug according to the invention in the decoupled state, in a side cross section view.

FIG. 4 shows a coupler plug 2 of the plug-in coupling 1 according to the invention in a side cross section view along the longitudinal axis LA2. The coupler plug 2 comprises a coupler plug housing 2.2, which is designed as a hollow body with its inner and outer circumferential sides being essentially rotationally symmetrical to the longitudinal axis LA2. The first coupler plug end 2.1 of the coupler plug housing 2.2 is designed for introduction into the coupler socket 3 to produce the coupled state of the plug-in coupling 1. For this purpose the first coupler plug end 2.1 of the coupler plug housing 2.2 on the end side has a ring-shaped end face 2.4 with a ring thickness a. The circular geometry of the end face 2.4 has approximately the same dimensions as the end face 8.8 of the valve body 8, and upon introduction of the coupler plug 2 into the coupler socket 3, the end faces 2.4, 8.8 of the coupler plug housing 2.2 and of the valve body 8 bear against each other.

The first coupler plug end 2.1, with the exception of one phase, has a cylindrical outer form with a diameter d, which has approximately the same dimensions as the opening of the coupler socket housing 3.2 on the first coupler socket end 3.1. The coupler plug housing 2.2, after a plug-in depth t (measured from the first coupler plug end 2.1) has a gradation 2.5, which forms a stop for the first coupler socket end 3.1 and serves as an insertion limit for the coupler plug 2 into the coupler socket 3, i.e. in the coupled state of the plug-in coupling 1 the gradation 2.5 bears against the end side of the first coupler plug end 2.1.

Inside the coupler plug 2 the inner conductor 4 is held movably, the movement of the inner conductor 4 positioned concentrically to the longitudinal axis LA2 taking place along the longitudinal axis LA2. The inner conductor 4 comprises a valve body 7 in the area of the first coupler plug end 2.1, in the form of a conically expanded, cylindrical, free end, which (valve body) is provided for sealing the circular end face 2.4 of the coupler plug 2. The valve body 7 is dimensioned so that the opening of the circular end face 2.4 of the coupler plug 2 with the diameter b is precisely sealed by the valve body 7. The valve body 7 also comprises preferably two grooves 7.1 extending circumferentially, which are designed for receiving a seal 16 and a spring contact 13. The seal 16 seals the end side opening of the coupler plug housing 2.2 in a liquid-tight manner by means of the valve body 7.

Guiding of the inner conductor 4 that is movable along the longitudinal axis LA2 and therefore also of the valve body 7 within the coupler plug housing 2.2 is achieved for example by means of an insulating disk 26 preferably of fiberglass-reinforced plastic, which preferably is permeated by several flow channels extending parallel to the longitudinal axis LA2. The insulating disk 26 comprises an inner bore hole with at least one gradation and is pushed onto a gradated area provided approximately centered on the inner conductor, the gradations of the insulating disk 26 and of the inner conductor 4 as well as the inner bore hole of the insulating disk and the outer diameter of the inner conductor 4 being geometrically adapted to each other.

The insulating disk 26 in the decoupled state of the plug-in coupling 1, spring-loaded by the spring 14, which in particular is embodied as a coil spring, is pressed against a gradation 2.6 in the inside of the coupler plug housing 2.2. By means of the gradation of the inner bore hole of the insulating disk 26 and by the gradated design of the inner conductor 4 in the area, onto which the insulating disk 26 is pushed, the spring force of the spring 14 is transferred to the inner conductor 4, thus causing the free end of the inner conductor 4 embodied as the valve body 7 to be held with its end side 4.1 flush with the end face 2.4 of the coupler plug housing 2.2, so that in the decoupled state the opening provided at this end face 2.4 is sealed in a liquid-tight manner by the valve body 7.

Upon introduction of the coupler plug 2 into the coupler socket 3 the inner conductor 4 and therefore also the valve body 7 is pushed along the longitudinal axis LA2 of the coupler plug 2 into the inside of the coupler plug housing 2.2, the valve body 7 being pushed back into the contact sleeve 12.

This contact sleeve 12 is connected by means of an insulating body 27 in an electrically insulated manner with the coupler plug housing 2.2. It further comprises one, preferably several flow channels, which enable the flow of a fluid along the longitudinal axis LA2. The contact sleeve 12 serves to electroconductively connect the top area 5.1.1 and of the valve body 7, namely of the inner conductors 4, 5 by means of the spring contact 13 in the coupled state of the plug-in coupling 1.

On the second coupler plug end 2.3 of the coupler plug housing 2.2 a reducing sleeve 25 is screwed on with its free end 25.1, this screw connection being sealed in a liquid-tight manner by a seal 16. This reducing sleeve 25 in turn serves as a connection with a hose fitting of a liquid-cooled electrical conductor, and this hose fitting can be screwed onto the free end 25.2 of the reducing sleeve 25. The electrical connection between the free end 4.2 of the inner conductor 4 with the electrical conductor of a hose fitting screwed onto the free end 25.2 of the reducing sleeve 25 is achieved by means of spring contacts 13, which are provided in grooves, secured against movement, on the free end 4.2 of the inner conductor 4. Upon introduction of the coupler plug 2 into the coupler socket 3 and the subsequent movement of the inner conductor 4, the free end 4.2 with its spring contacts 13 is pushed for example into a blind hole-like inner conductor end of the hose fitting, thus connecting the inner conductor 4 of the coupler plug 2 with the electrical conductor of the hose fitting.

In the following, in particular based on a synopsis of the plug-in coupling 1 as shown in FIGS. 1 and 2, the functional principal of the plug-in coupling 1 is explained. The starting point for this is the decoupled state, as shown in FIG. 1. The special characteristic of the decoupled state of the plug-in coupling 1 is that the openings provided on the first coupler plug end 2.1 and on the first coupler socket end 3.1 are sealed in a liquid-tight manner by the valve bodies 7, 8 moved in a spring-loaded manner. Due to the movement of the valve body 7 and therefore the movement of the inner conductor 4 out of the conductor of a hose fitting screwed onto the reducing sleeve 25, the free end 4.2 of the inner conductor 4 of the coupler plug 2 is pulled out and therefore electrically disconnected. In the coupler socket 3, in the decoupled state, the first and second inner conductor elements 5.1, 5.2 are electrically insulated from each other, since the contact sleeve 11, due to the spring loading of the valve body 8, is moved in the direction of the first coupler socket end 3.1, so that there is no electrical bridging of the insulating body 18 and of the ceramic pin 10 by means of this contact sleeve 11.

For introduction of the coupler plug 2 into the coupler socket 3, the former is moved with its first coupler plug end 2.1 toward the coupler socket 3 so that the end face 2.4 of the coupler plug housing 2.2 comes to bear against the end face 8.8 of the valve body 8 and the end side 4.1 of the inner conductor 4 comes to bear against the end side of the top area 5.1.1 of the first inner conductor element 5.1. This causes the longitudinal axes LA1, LA2 of the coupler plug 2 and of the coupler socket 3 to be aligned congruently in one axis.

Due to a pressure acting in the direction of the longitudinal axes LA1, LA2 on the coupler plug 2, the spring forces exerted by the springs 14, 15 are overcome, so that the valve body 8 and the inner conductor 4, which on its free end forms the valve body 7, are moved. The coupler plug 2 therefore enters with its first coupler plug end 2.1 the coupler socket 3 with plug-in depth t until the gradation 2.5 of the coupler plug 2 bears on the end side of the coupler socket housing 3.2, namely on the first coupler socket end 3.1.

The movement of the valve bodies 7, 8 during the plug-in process produces first a continuous fluid channel 6 and therefore a fluid connection in the plug-in coupling 1. Toward the end of the plug-in process the electrical connection is established. Due to the movement of the valve body 8 within the coupler socket 3 the contact sleeve 11 is pushed over the insulating body 18 that electrically insulates the first and second inner conductor element 5.1, 5.2. By means of the spring contacts 13, which preferably are ring-shaped and preferably consist of a copper zirconium-chrome alloy, a highly conductive electrical connection is produced by the first inner conductor element 5.1 through the spring contacts 13 and the contact sleeve 11, with an electric load capacity of up to 300 kW at an electric current of up to 400 A. The same requirements apply preferably likewise for all other contact points of the plug-in coupling 1.

During the plug-in process the first inner conductor element 5.1 is exposed at least to some extent, in particular in the top area 5.1.1 as a result of the valve body 8 being pushed back within the coupler socket 3. By insertion of the first coupler plug end 2.1 this exposed top area 5.1.1 and at least to some extent the adjoining inner conductor area 5.1.2 enters the inner space of the coupler plug housing 2.2 freed by the valve body 7 and the inner conductor 4. This causes the end side of the top area 5.1.1 and the end side 4.1 of the inner conductor 4 to bear against each other.

In the coupled state of the plug-in coupling 1 the valve body 7 of the coupler plug 2 and the top area 5.1.1 of the first inner conductor element 5.1 of the coupler socket lie in the area of the contact sleeve 12 and are surrounded in a form-fit manner by the latter. Due to the spring contacts 13 provided on the valve body 7 and the top area 5.1.1 the inner conductor 4 is electrically connected by the contact sleeve 12 with the first inner conductor element 5.1 of the inner conductor 5. By means of the contact sleeves 11, 12 in the coupled state electrical conductivity of the inner conductor 4 of the coupler plug is produced by the first inner conductor element 5.1 to the second inner conductor element 5.2 of the coupler socket.

Figure 5:
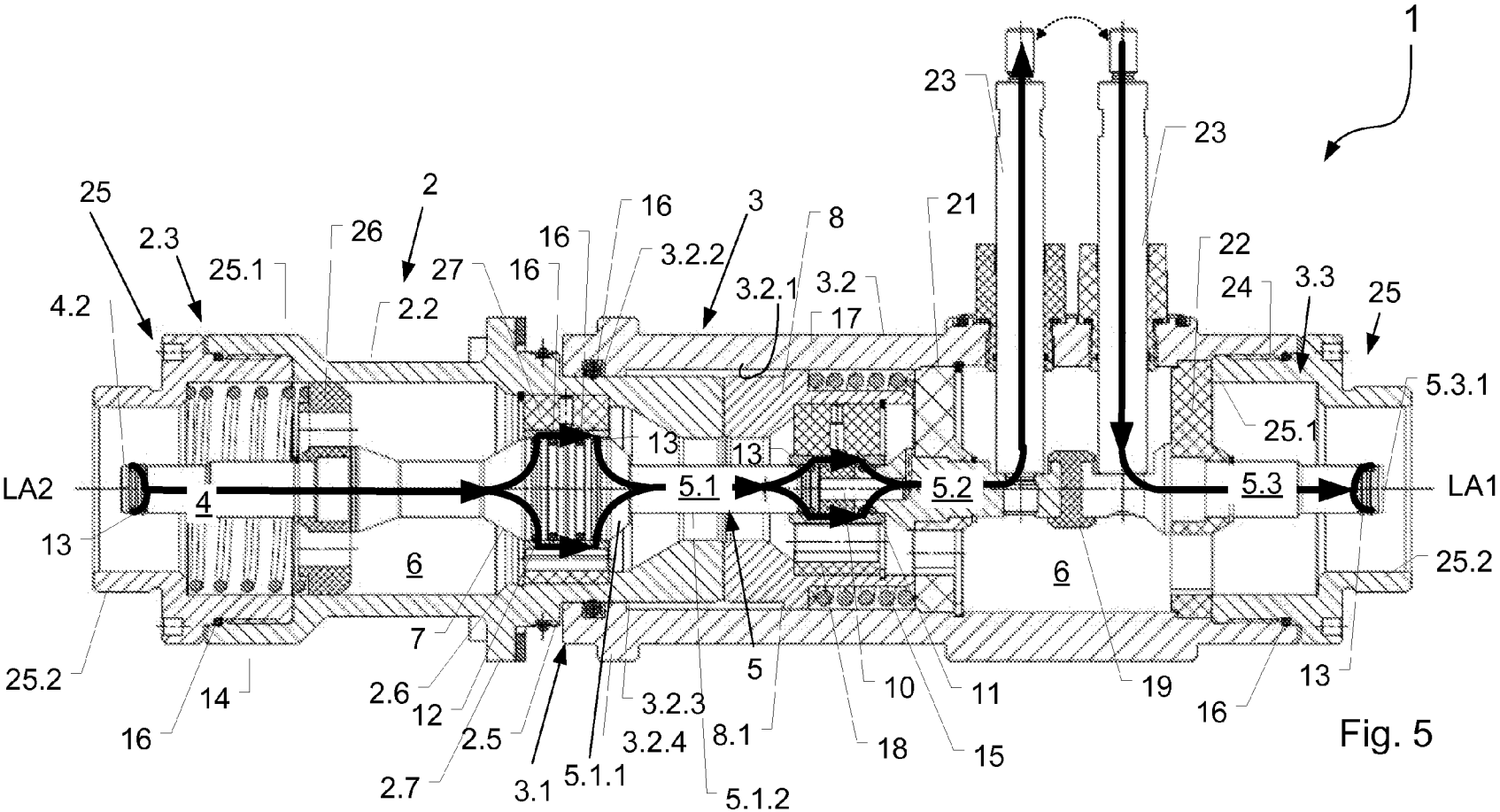
FIG. 5 shows exemplarily and schematically the electric current flow through a plug-in coupling according to the invention.

In the event that the pins 23 leading out of the coupler socket housing 3.2 are short circuited outside of the plug-in coupling 1, for example by means of a relay, continuous electrical conductivity of the plug-in coupling 1 is achieved as depicted by means of arrows in FIG. 5.

In addition to producing the electrical conductivity between the inner conductors 4, 5 of the coupler plug 2 and of the coupler socket 3, the liquid-tight seal produced upon introduction of the coupler plugs 2 into the coupler socket 3 must be canceled and a low-loss continuous fluid channel 6 through the plug-in coupling 1 must be established. As already explained, the valve bodies 7, 8 in the decoupled state seal the coupler plug 2 and the coupler socket 3 in a liquid-tight manner, the valve body 7 along its outer circumferential surface with the seal 16 sealing the coupler plug 2 and the valve body 8 on its outer circumferential side opposite the coupler socket housing 3.2 in the area of the first coupler socket end 3.1 and along its inner circumferential side opposite the top area 5.1.1 of the first inner conductor element 5.1 by means of seals 16.

Upon introduction of the coupler plug 2 into the coupler socket 3 and the movement described above of the inner conductor 4 and of the valve body 7 and the valve body 8 against the spring force of the springs 14, 15, the openings sealed by the valve bodies 7, 8 are exposed at least to some extent, enabling a fluid flow over the limit surface defined by the end side 2.4. Due to the fact that the fluid is preferably an insulating oil, which due to its insulating properties in particular suppresses electric arcs that could occur during the plug-in process, it is advantageous that the fluid flow during the plug-in process takes place prior to the electrical connection of the inner conductors 4, 5.

Figure 6:
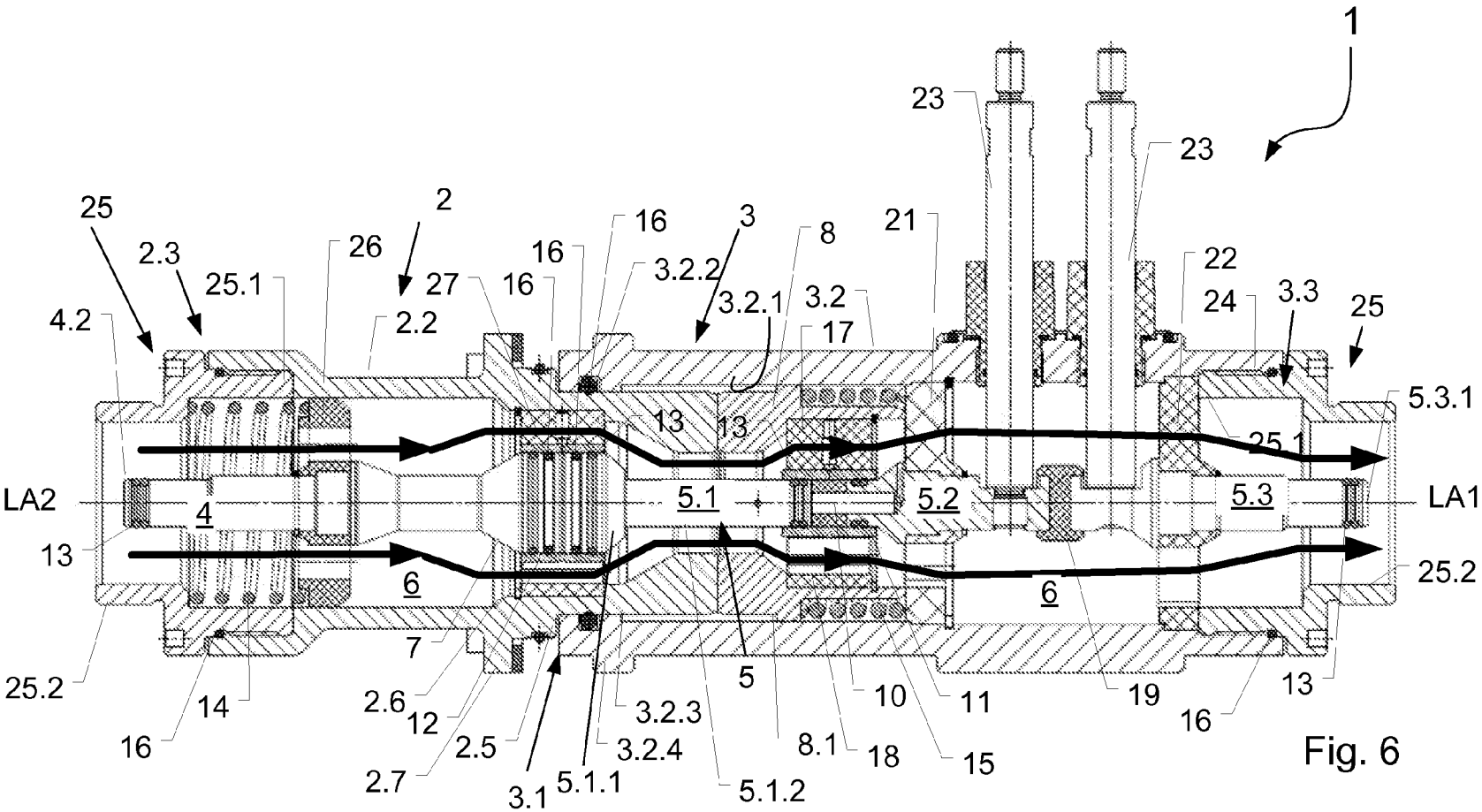
FIG. 6 shows exemplarily and schematically the fluid flow through a plug-in coupling according to the invention.

FIG. 6 shows the path of the fluid while flowing through the plug-in coupling 1. Due to the essentially rotationally symmetric design of the plug-in coupling 1 around the longitudinal axis LA, a fluid channel 6 is produced that completely surrounds the inner conductors 4, 5 on the circumferential side. At points where the inner conductors 4, 5 are supported against the coupler plug housing 2.2 and the coupler socket housing 3.2, the supporting element, i.e. the disks 21, 22, 26 and the insulating bodies 17, 27 are permeated by flow channels, which are dimensioned to enable a virtually loss-free flow of the fluid through the plug-in coupling 1. Of course, the direction of flow can also be in the opposite direction.

The valve body 7 and the top area 5.1.1 of the first inner conductor element 5.1 are of special significance for two reasons. Firstly, these elements, with their seals 16 extending along their circumference, provide a liquid-tight seal of the coupler plug 2 and of the coupler socket 3 in the decoupled state. Secondly, the electrical connection between the inner conductor 4 and the inner conductor 5 in the coupled state is achieved by the spring contacts 13 provided respectively on the valve body 7 and on the top area 5.1.1 of the first inner conductor element 5.1, which (spring contacts) lie on the respective elements next to the seals 16 described above. To achieve both an optimal liquid-tight seal in the decoupled state and a highly conductive electrical connection by means of the contact sleeve 12 in the coupled state, it is necessary that both the spring contacts 13 and the seal 16 have approximately the same geometric shapes and outer dimensions. Therefore, the spring contacts 13 are embodied as ring-shaped coil springs. In addition, the spring contact 13 should be elastically deformable so that it can be inserted into the contact sleeve 12 without jamming and also allows movement of the valve bodies 7, 8 without jamming, as a result of the spring forces of the springs 14, 15 alone.

Figure 7:
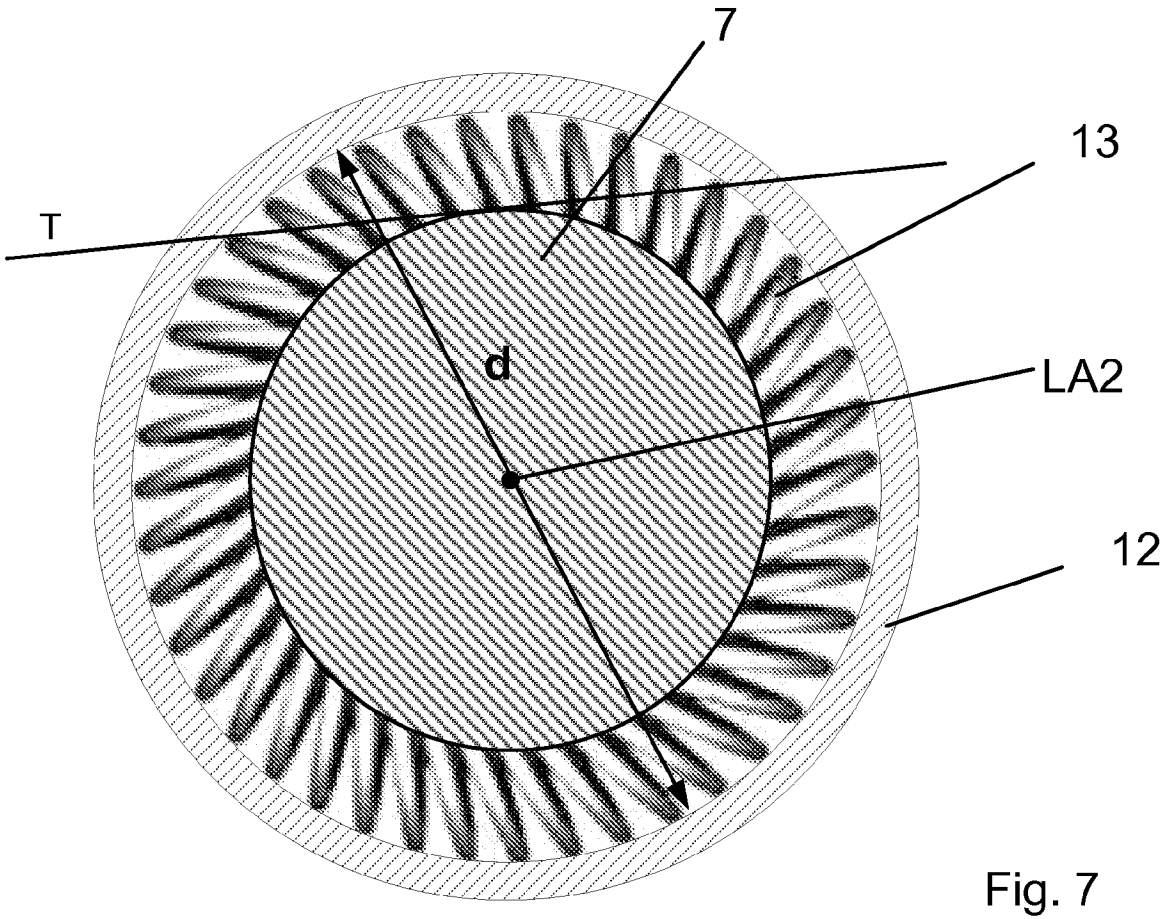
FIG. 7 shows exemplarily the electric contact of the inner conductor via the contact sleeve by means of the spring contacts.

FIG. 7 shows the contacting between the valve body 7 and the contact sleeve 12 in a cross section view perpendicular to the longitudinal axis LA2.

As a result of the circumferential spiral design of the spring contact 13 around the valve body 7, the latter can be introduced for example into the contact sleeve 12 or into the opening of the coupler plug housing 2.2 provided on the first coupler plug end 2.1, and its diameter b can be designed to be slightly smaller. For this purpose, the spring contact 13 is deformed so that the single coils of the spring contacts 13 occupy a smaller angle to the tangent T on the valve body 7 than is the case prior to deformation.

Figure 8:
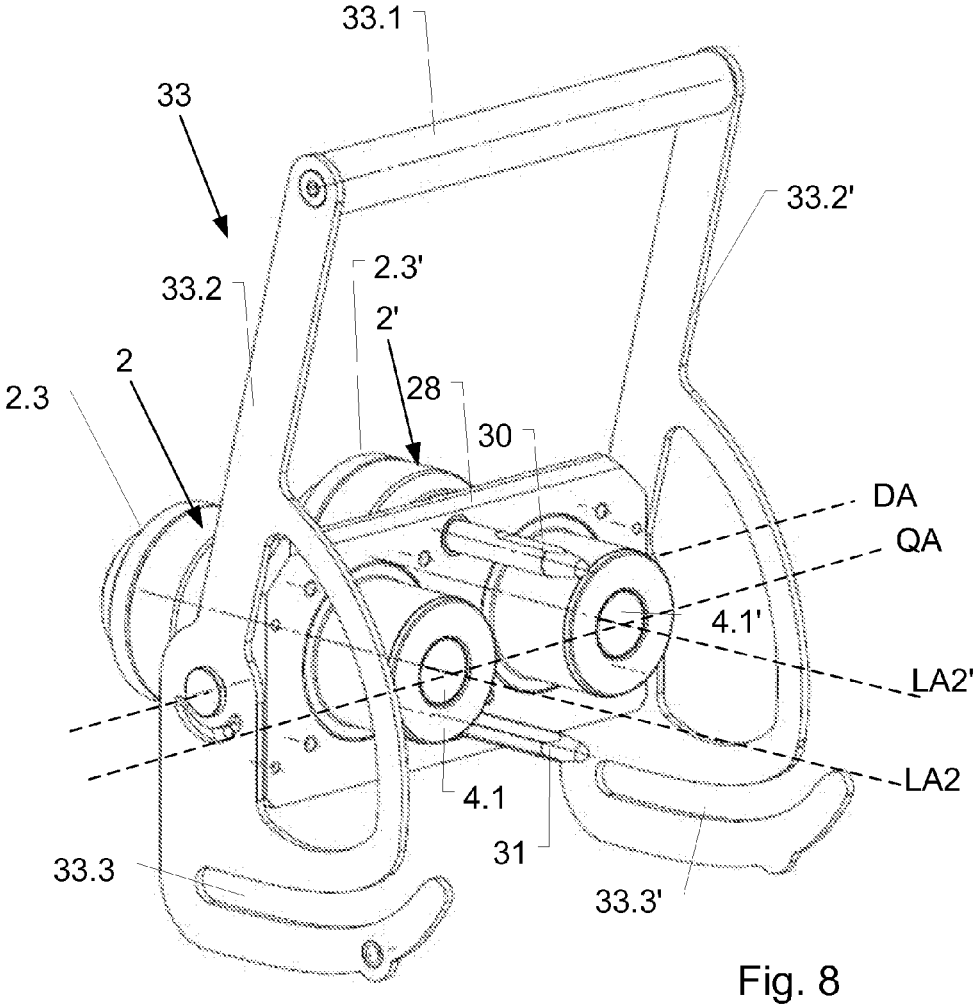
FIG. 8 shows exemplarily the arrangement of two coupler plugs on a coupler plug plate, in a perspective view.
Figure 9:
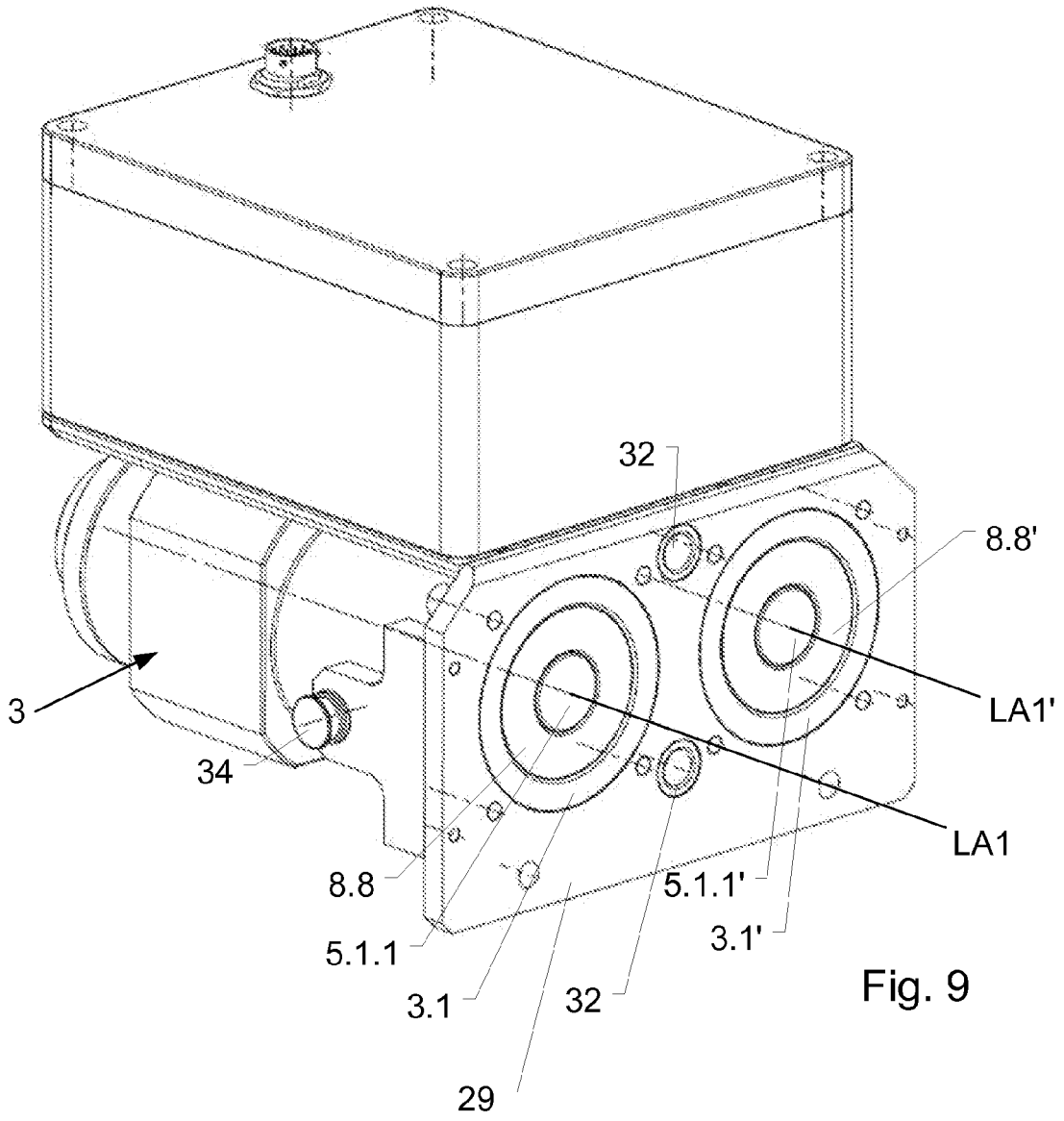
FIG. 9 shows exemplarily the arrangement of two coupler sockets on a coupler socket plate, in a perspective view.

The plug-in coupling 1, which for example has an electric load capacity of up to 300 kW at an electric current of up to 400 A and preferably is designed for the transfer of direct current and direct voltage, is preferably, as shown in FIGS. 8 and 9, arranged in pairs, in which case two coupler plugs 2, 2' are arranged at a distance next to each other by means of one coupler plug plate 28, so that the center points of the circular end sides of the coupler plugs 2, 2' are received in the transverse axis QA extending perpendicular to the longitudinal axes LA2, LA2'.

The coupler plugs 2, 2' enter with their first coupler plug ends 2.1, 2.1' the coupler plug plate 28 in round circular openings, the coupler plugs 2, 2' being brought to bear with their end faces of the flange 2.7 facing the first coupler plug ends 2.1, 2.1' on the back side against the coupler plug plate 28 and preferably are screwed to the latter. The pair-wise arrangement of two coupler plugs 2, 2' on the coupler plug plate 28 also enables a connection of two coupler plugs 2, 2' with two coupler sockets 3, 3', so that a closed electric circuit and a fluid circuit consisting of forward and return lines can be achieved in a single coupling process.

Likewise, a corresponding arrangement of two coupler sockets 3, 3' on one coupler socket plate 29 is provided, the single coupler sockets 3, 3' being arranged by means of the flange 3.2.4 on the coupler socket plate 29. The coupler sockets 3, 3' enter with their first coupler socket end 3.1, 3.1' the coupler socket plate 29 preferably with an exact fit at circular openings, in which case the coupler socket plate 29 comes to bear on the end side of the flange 3.2.4 facing the first coupler socket end 3.1, 3.1' and preferably being exactly flush with the first coupler socket end 3.1, 3.1', i.e. essentially forming one plane with the latter.

To enable a coupling process without jamming, it is necessary to align the coupler plugs 2, 2' to the coupler sockets 3, 3', so that the coupler plugs 2, 2' can easily be inserted into the coupler sockets 3, 3'. For this purpose the coupler plug plate 28 is provided with a centering pin 30 and a troche 31, which protrude perpendicularly from the coupler plug plate 28 parallel to the longitudinal axes LA2, LA2'. The centering pin 30 and the troche 31 are arranged in the center between the two coupler plugs 2, 2' and offset to the transverse axis QA. The centering pin 30 serves during introduction of the coupler plug 2, 2' into the coupler socket 3, 3' to center these elements in relation to each other, i.e. the centering pin 30 limits the movement of the coupler plug 2, 2' in the horizontal and vertical direction of movement. The troche 31, which for example has a prism shape for compensation of production tolerances, is provided to avoid rotation around the centering pin 30. The centering pin 30 and the troche 31 cooperate on the coupler socket plate 29 with flange sleeves 32 and are inserted into these flange sleeves 32 during the coupling process.

To achieve a releasable, secure mechanical locking of the coupler plug 2, 2' and the coupler socket 3, 3', a crescent lever 33 is provided on the coupler plug plate 28, which (lever) cooperates with pins 34 that are connected with the coupler socket plate 29.

The crescent lever 33 is bow-shaped and a grip 33.1 connects two crescent lever halves 33.2, 33.2' located on the side of the coupler plug plate 28 with each other. The crescent lever halves 33.2, 33.2' are mounted rotatably around a rotation axis DA extending perpendicular to the longitudinal axis LA2, LA2' of the coupler plug 2, 2' and parallel to the transverse axis QA and each one has a crescent-shaped recess 33.3, 33.3'. These recesses 33.3, 33.3' are designed to receive the pins 34 mounted on the coupler plug plate 29.

To lock the plug-in couplings 1, 1' first the centering pin 30 and the troche 31 are moved toward the flange sleeves 32 and inserted into the latter and then the pins 34 are engaged with the recesses 33.3, 33.3' of the crescent lever 33. By pivoting the crescent lever 33 so that the grip 33.1 is pivoted in the direction of the second coupler plug ends 2.3, 2.3' the pins 34 slide into the recesses 33.3, 33.3'. Due to the design of the crescent-shaped recesses 33.3, 33.3' so that their radius relative to the rotation axis DA becomes smaller toward the closed recess end, the coupler plugs 2, 2' are increasingly moved toward the coupler sockets 3, 3' by the pivoting of the crescent lever 33. The coupled state of the plug-in couplings 1, 1' is achieved when the pins 34 reach the ends of the recesses 33.3, 33.3' and the coupler plug plate 28 and the coupler socket plate 29 come to bear against each other. Release of the plug-in couplings 1, 1' is achieved by pressing the crescent lever 33 in the opposite direction.

The plug-in coupling 1 according to the invention is preferably flowed through by an insulating oil with very good electrical insulating properties, therefore ensuring electric insulation of the inner conductors 4, 5 from the coupler plug housing 2.2 and the coupler socket housing 3.2 in the areas of the fluid channels 6. The coupler plug housing 2.2 and the coupler socket housing 3.2 are connected respectively with the chassis ground, i.e. for example with the ground of the vehicle or the mounted implement, so that in the coupled state they are electrically connected by these grounds and therefore have the same voltage.

In addition to electrical insulation the insulating oil also serves to thermally cool the inner conductors 4, 5 of the plug-in coupling 1, the insulating oil being forced with pressures of up to 20 MPa, preferably pressures of less than 6 MPa, through the plug-in coupling 1 in the coupled state. The plug-in coupling 1 is designed for a maximum flow rate of the insulating oil of 3 m per second at a volume flow of 120 cubic decimeters per minute.

In addition to insulation and cooling, the insulating oil also performs the task of suppressing electric arcs that can occur during the coupling process.

The material used for the plug-in coupling 1, in particular its coupler plug housing 2.2 and coupler socket housing 3.2, the valve bodies 7, 8 and the inner conductors 4, 5 is preferably steel, in particular a non-corrosive steel, for example stainless steel.

The invention was described above based on an exemplary embodiment. It goes without saying that numerous modifications and variations of the invention are possible without abandoning the underlying inventive idea.

REFERENCE LIST

1 Plug-in coupling
2, 2' coupler plug
2.1, 2.1' first coupler plug end
2.2 coupler plug housing
2.3 second coupler plug end
2.4 end face
2.5 gradation
2.6 gradation
2.7 flange
3, 3' coupler socket
3.1, 3.1' first coupler socket end
3.2 coupler socket housing
3.2.1 inner side
3.2.2 groove
3.2.3 gradation
3.2.4 flange
3.3 second coupler socket end
4 inner conductor
4.1 end side
4.2 free end
5 inner conductor
5.1 first inner conductor element
5.1.1 top area
5.1.1.1 groove
5.1.2 inner conductor area
5.2 second inner conductor element
5.3 third inner conductor element
5.3.1 free end
6 fluid channel
7 valve body
7.1 groove
8 valve body
8.1 first gradation
8.2 second gradation
8.3 sub-section
8.4 sub-section
8.5 first inner side area
8.6 second inner side area
8.7 gradation
8.8 end face
10 ceramic pin
11 contact sleeve
12 contact sleeve
12.1 inner side of contact sleeve
13 spring contact
14 spring
15 spring
16 seal
17 insulating body
18 insulating body
19 insulating body
21 insulating disk
22 insulating disk
23 pin
24 inner thread
25 reducing sleeve
25.1 free end
25.2 free end
26 insulating disk
27 insulating body
28 coupler plug plate
29 coupler socket plate
30 centering pin
31 troche
32 flange sleeve
33 crescent lever
33.1 grip
33.2, 33.2' crescent lever half
33.3, 33.3' recesses
34 pin
a ring thickness
b diameter
c outer diameter
d diameter
t plug-in depth
DA rotation axis
LA1, LA1' longitudinal axis
LA2, LA2' longitudinal axis
QA transverse axis
T tangent

The invention claimed is:

1. Plug-in coupling for the transfer of high-power energy and for the transfer of a fluid under pressure, comprising:

at least one coupler plug (2) and at least one coupler socket (3), in which the coupler plug (2) can be introduced into the coupler socket (3) at least to some extent to produce a coupled state and can be removed from the coupler socket (3) to produce a decoupled state, characterized in that the coupler socket (3) and the coupler plug (2) respectively comprise an inner conductor (4, 5) which is electroconductive in at least some sections and which is surrounded by a fluid channel (6) in at least some sections and that the coupler socket (3) and the coupler plug (2) have means (7, 8) for sealing the fluid channel (6) in a liquid-tight manner in the decoupled state and for producing a continuous fluid channel (6) in the coupled state, characterized in that the means are spring-loaded, movable valve bodies (7, 8), characterized in that the valve bodies (7, 8) in the coupled state are moved so that the plug-in coupling (1) forms a continuous fluid channel (6), characterized in that at least one of the valve bodies (7, 8) is designed to produce an electroconductive connection between the inner conductors (4, 5) of the coupler socket (3) and of the coupler plug (2), wherein the valve body (7) of the coupler plug (2) consists at least to some extent of the inner conductor (4), wherein the coupler socket (3) comprises a coupler socket housing (3.2), the valve body (8) being movable between the inner conductor (5) and the coupler socket housing (3.2).

2. The plug-in coupling according to claim 1, characterized in that the valve body (8) of the coupler socket (3) has a sleeve-like design.

3. The plug-in coupling according to claim 2, characterized in that an electrically conductive contact sleeve (11) is electrically connected with the valve body (8) of the coupler socket (2).

4. The plug-in coupling according to claim 3, characterized in that the contact sleeve (11) surrounds the inner conductor (5) of the coupler socket (3) on a partial length and can be moved relative to said inner conductor, wherein the inner conductor (5) of the coupler socket (3) is embodied as having several parts, wherein the inner conductor (5) comprises at least two inner conductor elements (5.1, 5.2) that are connected with each other in an electrically insulated manner.

5. The plug-in coupling according to claim 4, characterized in that the at least two inner conductor elements (5.1, 5.2) are connected with each other by an electrically insulating pin, in particular a ceramic pin (10).

6. The plug-in coupling according to claim 5, characterized in that the two inner conductor elements (5.1, 5.2) in the coupled state are connected in an electrically conductive manner by means of the contact sleeve (11).

7. The plug-in coupling according to claim 6, characterized in that the contact sleeve (11) connecting the two inner conductor elements (5.1, 5.2) in the coupled state is the contact sleeve (11) that is connected with the valve body (8) of the coupler socket (3).

8. The plug-in coupling according to claim 7, characterized in that at least one electrically conductive contact sleeve (12) is provided for producing an electroconductive connection between the inner conductor (4) of the coupler plug (2) and the inner conductor (5) of the coupler socket (3) in the coupled state.

9. The plug-in coupling according to claim 8, characterized in that the inner side of the contact sleeve (12.1) simultaneously forms a contact and a sealing surface, wherein the contact between the contact sleeves (11, 12) and the inner conductors (4, 5) of the coupler plug (2) and the coupler socket (3) consists respectively of ring-shaped spring contacts (13).

10. The plug-in coupling according to claim 9, characterized in that the fluid is an electrically insulating coolant, in particular an insulating oil.

11. The plug-in coupling according to claim 10, characterized in that in the coupled state the coupler plug housing (2.2) and the coupler socket housing (3.2) are connected in an electrically conductive manner and form the chassis ground, wherein the coupler plug (2) and the coupler socket (3) are designed so that during transition from the decoupled state to the coupled state, first the fluid connection and then the electrical connection between the coupler plug (2) and the coupler socket (3) is produced.

12. The plug-in coupling according to claim 11, characterized by cooling of the inner conductors (4, 5) by the fluid.

13. The plug-in coupling according to claim 12, characterized by an electric load capacity of up to 300 kW at an electric current of up to 400 A.

14. An arrangement of at least two plug-in couplings comprising:

at least two coupler plugs (2, 2') and at least two coupler sockets (3, 3'), in which the coupler plugs can be introduced into the coupler sockets at least to some extent to produce a coupled state and can be removed from the coupler socket (3) to produce a decoupled state, characterized in that the coupler socket (3) and the coupler plug (2) respectively comprise an inner conductor (4, 5) which is electroconductive in at least some sections and which is surrounded by a fluid channel (6) in at least some sections and that the coupler socket (3) and the coupler plug (2) have means (7, 8) for sealing the fluid channel (6) in a liquid-tight manner in the decoupled state and for producing a continuous fluid channel (6) in the coupled state, wherein the coupler plugs (2, 2') and the coupler sockets (3, 3') of the plug-in couplings are connected with each other so that their first coupler plug ends (2.1, 2.1') and their first coupler socket ends (3.1, 3.1') form one plane, characterized in that the means consist of a lever mechanism (33) or a gear.

15. The arrangement according to claim 14, characterized in that means (33) are provided for simplified connection of the coupler plugs (2, 2') and the coupler sockets (3, 3') and for securing the coupled state.

16. The arrangement according to claim 14, characterized in that a centering device (30, 31, 32) is provided that counteracts tilting of the plug-in coupling elements (2, 2', 3, 3') against each other.

* * * * *